US005456031A

United States Patent [19]

Hou

[11] Patent Number: 5,456,031

[45] Date of Patent: Oct. 10, 1995

[54] DECORATIVE DISPLAY DEVICE HAVING IMPROVED SUPPORT STRUCTURE

[75] Inventor: Jack Hou, Taipei, Taiwan

[73] Assignee: Giftec, Ltd., Alexandria, Va.

[21] Appl. No.: 400,454

[22] Filed: Mar. 7, 1995

Related U.S. Application Data

[63] Continuation of Ser. No. 197,769, Feb. 16, 1994, abandoned, which is a continuation-in-part of Ser. No. 966,890, Oct. 27, 1992, abandoned.

[51] Int. Cl.[6] ..... G09F 19/00

[52] U.S. Cl. ..... 40/410; 40/411

[58] Field of Search ..... 40/406, 409, 410, 40/411, 414; 446/267; 403/260, 341

[56] References Cited

U.S. PATENT DOCUMENTS

| | | | |
|---|---|---|---|
| 1,782,944 | 11/1930 | Stanford et al. . | |
| 2,018,836 | 10/1935 | Clemence . | |
| 2,518,502 | 8/1950 | Snyder . | |
| 2,709,217 | 5/1955 | McCluskey . | |
| 3,827,814 | 8/1974 | Laurent et al. | 403/341 X |
| 4,072,844 | 2/1978 | Marchese . | |
| 4,771,902 | 9/1988 | Teng . | |
| 4,852,283 | 8/1989 | Teng . | |
| 4,961,276 | 10/1990 | Lin . | |
| 5,018,288 | 5/1991 | Yang . | |
| 5,065,289 | 11/1991 | Teng . | |
| 5,070,633 | 12/1991 | Liu . | |
| 5,088,218 | 2/1992 | Liu . | |
| 5,090,144 | 2/1992 | Liu . | |
| 5,092,065 | 3/1992 | Teng . | |
| 5,105,343 | 4/1992 | Wakimoto . | |
| 5,110,636 | 5/1992 | Hou . | |
| 5,131,175 | 7/1992 | Liu . | |
| 5,213,540 | 5/1993 | Yang | 40/406 X |

FOREIGN PATENT DOCUMENTS 2080129 2/1982 United Kingdom .

*Primary Examiner*—Brian K. Green
*Attorney, Agent, or Firm*—Bacon & Thomas

[57] ABSTRACT

A decorative display device having an improved support structure is disclosed which enables at least the exterior portion of the base to be formed of glass material. The transparent housing and stopper member assembly is mounted on a support which may be formed separately from an external base portion which has an improved aesthetic appearance. The support is associated with the base so as to support the transparent housing. The transparent housing may be attached to the support by adhesive, since the support need not be formed of glass material and the adhesively bonded portions will be hidden from view by the decorative base member. The improved support structure prevents any possibility of adhesive being inadvertently placed on the exterior surfaces of the base, thereby improving the appearance of the decorative display device.

36 Claims, 10 Drawing Sheets

DECORATIVE DISPLAY DEVICE HAVING IMPROVED SUPPORT STRUCTURE

This application is a Continuation of application Ser. No. 08/197,769, filed Feb. 16, 1994, now abandoned, which application is a Continuation-In-Part of U.S. Ser. No. 07/966,890, filed Oct. 27, 1992, now abandoned.

BACKGROUND OF THE INVENTION

The present invention relates to devices for displaying ornamental objects, more particularly such a device having an improved structure for supporting the ornamental display.

Decorative display devices having one or more decorative objects supported on a decorative display base are well known. Such display devices may enclose the decorative object with a transparent housing filled with water or other liquid, which may have particles of material suspended therein in order to improve the aesthetic effects of the device.

Display devices of this type generally include a spherical housing formed of glass or transparent plastic material which has a bottom facing opening defined by an outwardly extending neck portion which permits the housing to be filled with the liquid and the decorative object to be displayed. The bottom opening is sealed with a liquid tight gasket, which may be frictionally or threadedly engaged with the neck portion. This assembly is then placed on a pedestal-type base which is generally formed of wood or plastic material.

These prior art devices have typically been assembled using adhesive to bond the transparent housing/gasket assembly to the wood or plastic base. Unless the quantity of adhesive is carefully controlled and carefully applied, it will mar the exterior surface of the base resulting in a product with an unacceptable appearance. Also, the use of adhesives has limited the materials from which the base may be fabricated to materials which will bond with the adhesive. This has, in the past, prohibited the use of glass bases for decorative article display devices, since the adhesive will not adequately bond to the smooth, impervious surface of glass.

The use of glass material to form the base of the decorative display object results in such an object having an improved aesthetic appearance over the prior art devices.

SUMMARY OF THE INVENTION

A decorative display device having an improved decorative object support structure is disclosed which enables an exterior portion of the base to be formed of glass material. The transparent housing and stopper member assembly form part of a decorative object support which is separate from a support base and a decorative base member which has an improved aesthetic appearance. The decorative object support is associated with the support base so as to clamp the decorative base member in position without using adhesive. The transparent housing of the decorative object support may be attached to a support ring by adhesive, since the support ring need not be formed of glass material and the adhesively bonded portions will be hidden from view by the decorative base member. Alternatively, the transparent housing assembly may be frictionally attached to the support ring, clamped to the support ring, or may be attached thereto by threaded fasteners. Regardless of the attachment method utilized, the improved support structure prevents any possibility of adhesive being inadvertently placed on the exterior surfaces of the base, thereby improving the appearance of the decorative display device.

The decorative base member defines a hollow interior which may be used to accommodate a music box mechanism, or a light assembly to illuminate the interior of the device. The music box mechanism may provide only music, or may also rotate or otherwise move the decorative object.

It is an object of the present invention to provide a decorative display device having an improved support structure which will make assembly and manufacture of the device easier than the prior art devices, while at the same time preventing any possibility of adhesive material marring the exterior surface of the device.

It is another object of the invention to provide a decorative display device having a base with at least an exterior portion formed of a glass material to improve the quality and aesthetic appearances of the device.

Other objects, features and advantages of the invention will become apparent from the following detailed description of preferred embodiments thereof, when taken in conjunction with the drawings wherein like reference numerals refer to corresponding parts in the several views.

DETAILED DESCRIPTION OF THE PREFERRED EMBODIMENTS

Figure 1:
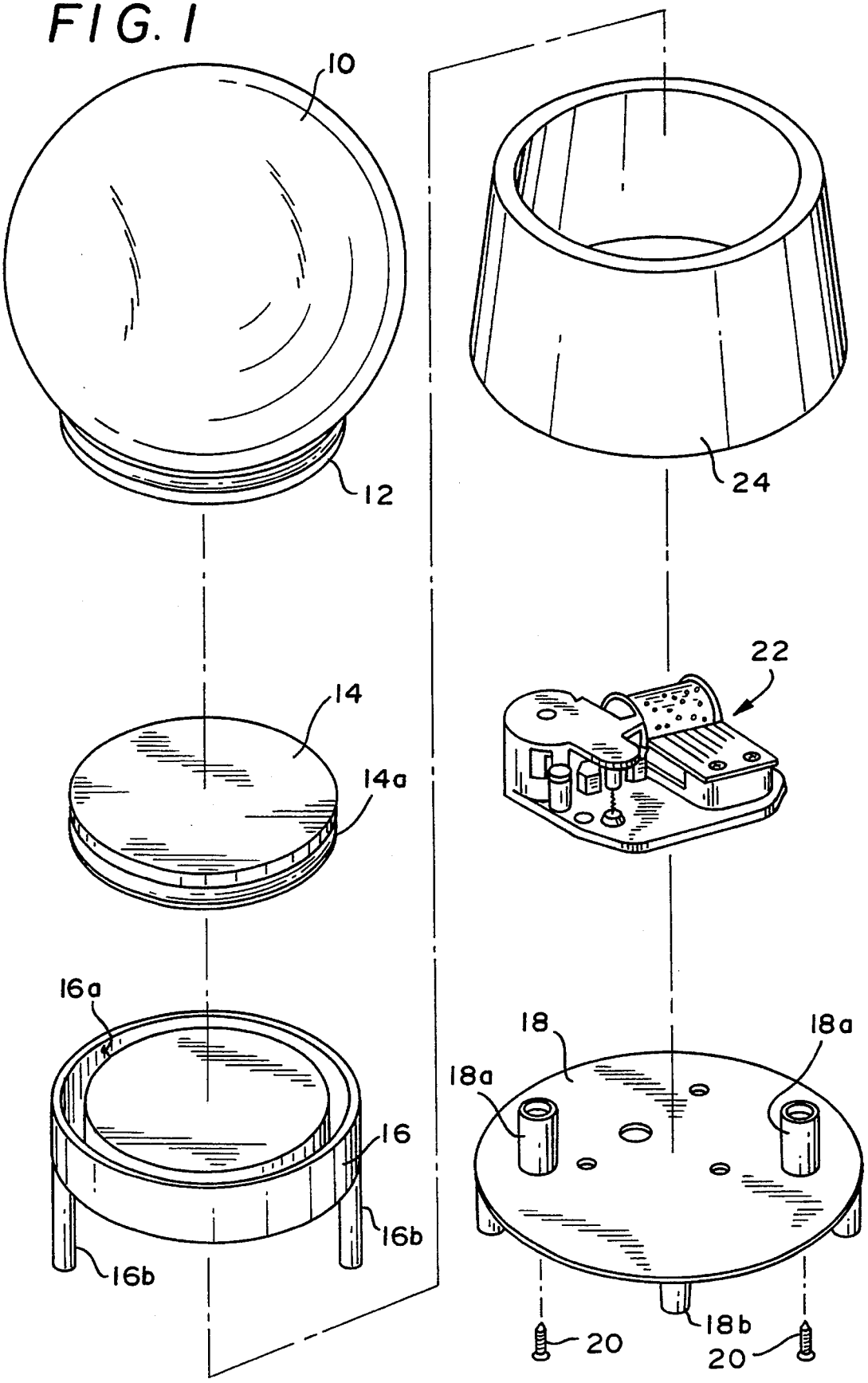
FIG. 1 is a exploded, perspective view of a first embodiment of the display device according of the present invention.
Figure 2:
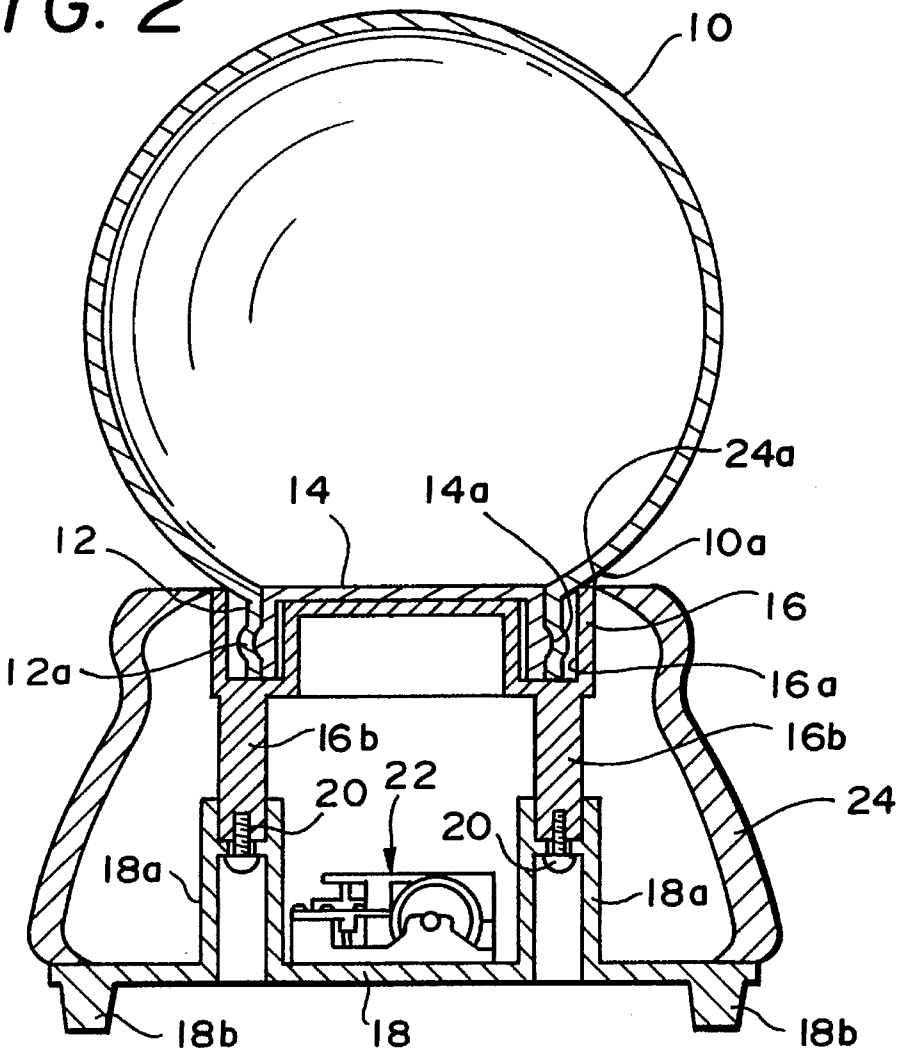
FIG. 2 is a vertical, cross-sectional view of the display device illustrated in FIG. 1.

A first embodiment of the decorative display device according to the present invention, is illustrated in FIGS. 1 and 2. As can be seen, the device comprises a transparent housing 10 which may be formed of any transparent material and may have a generally spherical shape with a neck portion 12 extending therefrom which defines a generally downwardly facing bottom opening. A stopper member 14 fits within the neck portion 12 of the transparent housing 10 to seal the bottom opening of the transparent housing in a fluid tight fashion. Stopper member 14 may be formed with a generally outwardly extending ridge 14*a* which engages a corresponding indentation 12*a* defined by the neck portion 12 of the transparent housing 10. Quite obviously, other means may be provided between the stopper member 14 and the neck portion 12 to enable the stopper member 14 to seal the bottom opening of the transparent housing 10.

The transparent housing/stopper member assembly is supported on a support means which, in this embodiment, comprises a support ring 16 attached to support base 18. Support ring 16 defines generally upwardly facing groove 16*a* adapted to accommodate therein the neck portion 12 along with the stopper member 14, as illustrated best in FIG. 2. A known adhesive may be placed between the neck portion 12 and the walls of the groove 16*a* in order to fixedly attach the transparent housing 10 to the support ring 16.

Support ring 16 has support rods 16b extending downwardly therefrom whose distal ends are engaged with the corresponding distal ends of supports 18*a* extending upwardly from the support base 18. Legs 18*b* extend from the support base 18 and are adapted to rest on a surface so as to support the display device thereon. The distal ends of support rods 16*b* may be adhesively or frictionally engaged with corresponding recesses defined by the distal ends of supports 18*a*, or threaded fasteners 20 may be inserted into these respective elements, as illustrated in FIG. 2.

Music box mechanism 22 may be mounted on the support member 18. The music box 22 may be of any known type, such as a spring operated wind-up music box, or an electrically powered music box. In the former case, a wind-up key may extend exteriorly of the device in known fashion.

In assembling the decorative display device according to this invention, a decorative object (not shown) is mounted on stopper member 14 or placed within the transparent housing 10 which may then be filled with water or other liquid. The stopper member 14 is then affixed to the neck portion 12 of the transparent housing to seal the contents within the transparent housing 10. This assembly is then affixed to support ring 16 by friction engagement, adhesive bonding, or other connection methods to fixedly attach these elements together.

A decorative base member 24 having a generally hollow interior and which may be open at both ends is placed onto the support base 18. The decorative base member 24 need not be bonded to, or otherwise attached to the support base 18, since the transparent housing 10 will hold or clamp the decorative base member 24 in position by the contact between portion 10*a* and contact portion 24*a* when the support member 16 is attached to the base member 18, as illustrated in FIG. 2. In the present invention, there is no means directly affixing the transparent housing 10 to the decorative base member 24 and, thus, the decorative base member 24 may be formed of any material, even glass which would not ordinarily be receptive to adhesive bonding. The use of glass for the decorative base member 24 imparts a higher quality, more aesthetically pleasing appearance to the display device than the known prior art devices.

In addition, the only use of adhesive in the present device is to attach the transparent housing/stopper member assembly to the support ring 16, the juncture of these elements being visually concealed by the decorative base member 24. Thus, any inadvertent application of adhesive to the exterior surface of support ring 16 will be invisible when the device is assembled.

Figure 3:
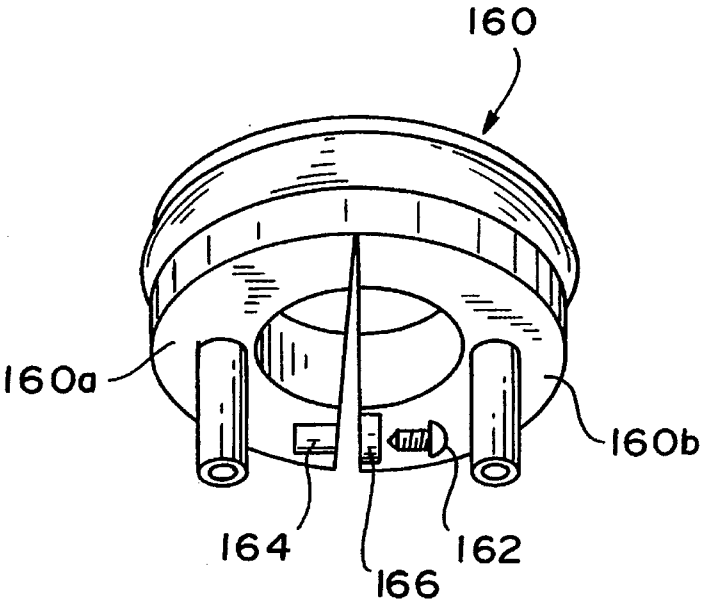
FIG. 3 is a perspective view of an alternative support structure which may be utilized with the present invention.

The support ring construction may be altered to that shown in support ring 160, illustrated in FIG. 3. In this modification, the support ring 160 is formed of two support ring portions 160*a* and 160*b* which are hingedly attached together. The hinged support ring 160 may be formed by cutting a one-piece support ring almost entirely across its diameter, but leaving a wall portion joining these portions together so as to form a living hinge. This enables the support ring 160 to be clamped around the neck portion 12 of the transparent housing 10. A clamping force is generated by screw 162 which passes between threaded members 164 and 166 attached to each of the support ring portions, respectively.

Figure 5:
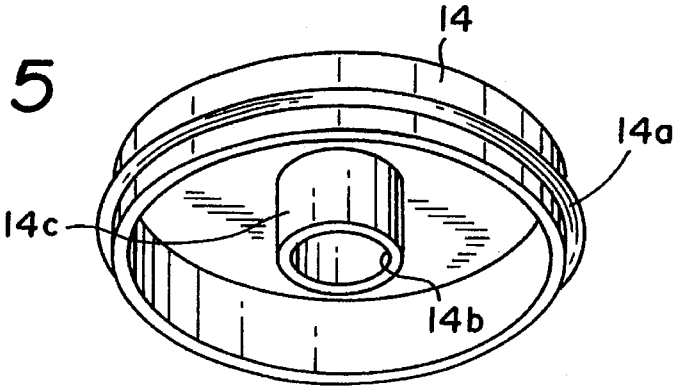
FIG. 5 is a perspective view of the stopper utilized in the embodiment illustrated in FIG. 4.
Figure 6:
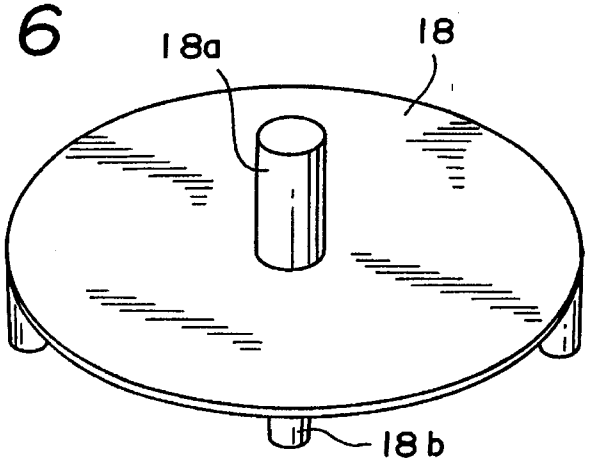
FIG. 6 is a perspective view of the support base utilized in the embodiment illustrated in FIGS. 4 and 5.
Figure 4:
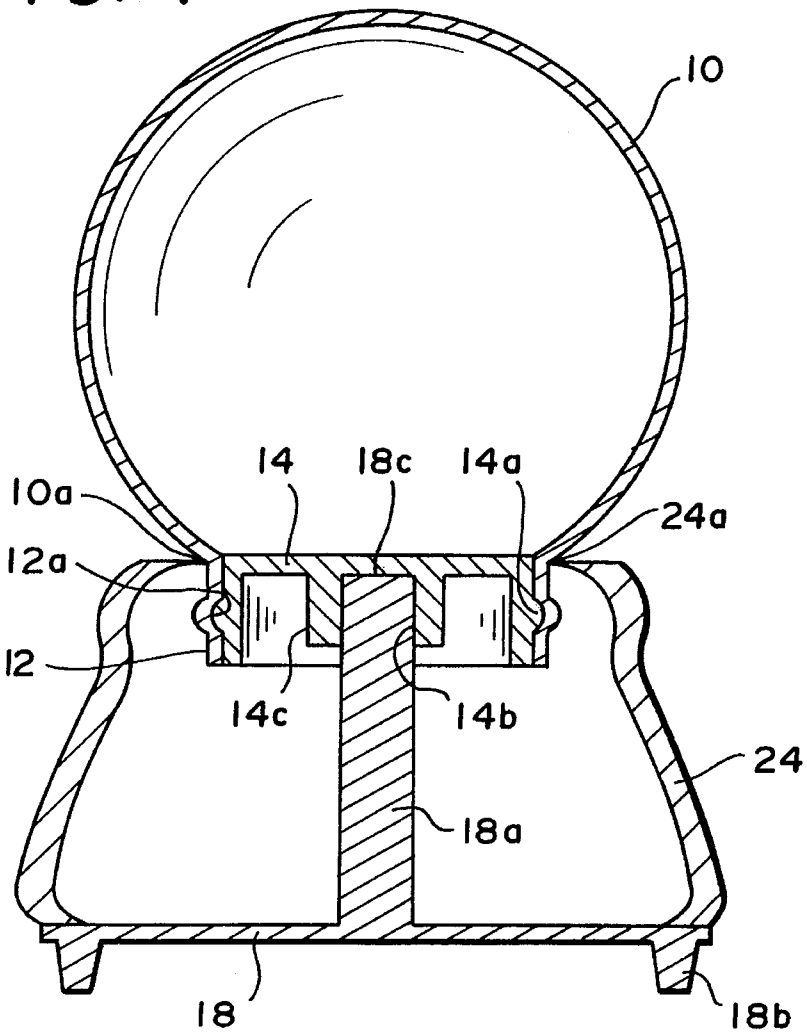
FIG. 4 is a vertical, cross-sectional view of a second embodiment of the display device according to the present invention.

In the embodiment illustrated in FIGS. 4–6, the support means is simplified so as to eliminate the support ring 16. In this embodiment, the support base 18 has a single support 18*a* extending upwardly therefrom having a distal end 18*c* which engages a recess 14*b* defined by a boss 14*c* extending from the stopper member 14. Adhesive may be interposed between the distal end of support rod 18*a* and the recess 14*b*, or these elements may be dimensioned so as to be frictionally engaged with each other.

Figure 7:
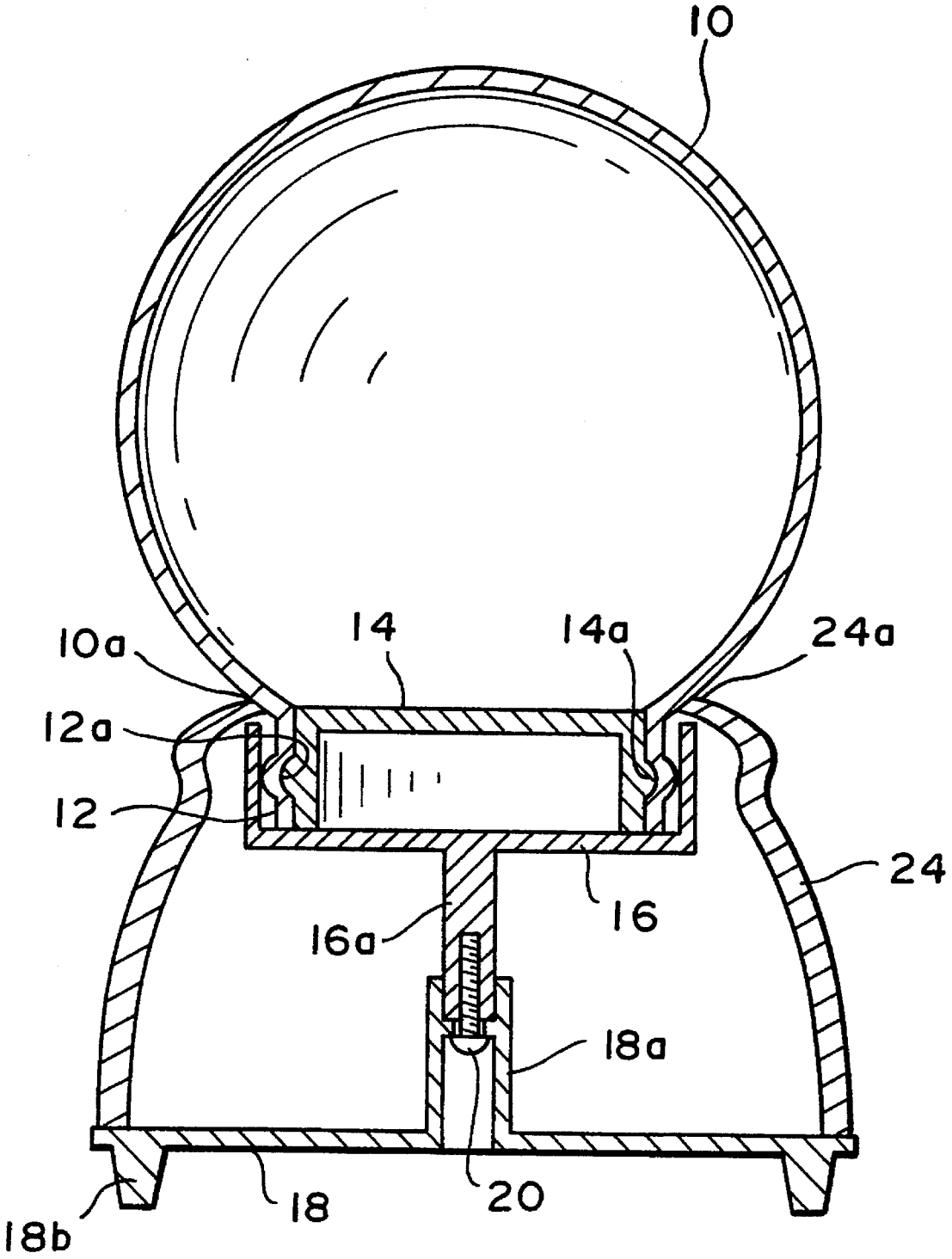
FIG. 7 is a vertical, cross-sectional view of a third embodiment of the invention according to the present invention.

In the embodiment illustrated in FIG. 7, the pair of support rods 16*b* extending downwardly from the support ring 16, illustrated in FIG. 1, have been replaced by a single support rod 16*b*. As in the embodiment described in FIG. 1, the distal end of the support rod 16*b* engages the distal end of support 18*a* which extends upwardly from the support base 18. Any known means may be utilized to affix these elements together, such as threaded fastener 20. As in the previously described embodiment, the support ring 16 may be adhesively bonded to the neck portion 12 of the transparent housing 10.

Figure 9:
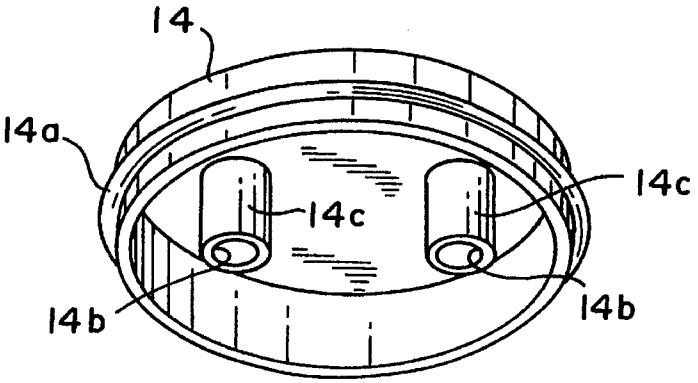
FIG. 9 is a perspective view of the stopper utilized with the display device illustrated in FIG. 8.
Figure 10:
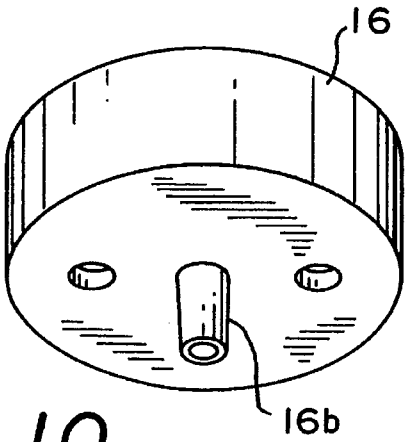
FIG. 10 is a perspective view of the support member utilized with the embodiment illustrated in FIGS. 8 and 9.
Figure 8:
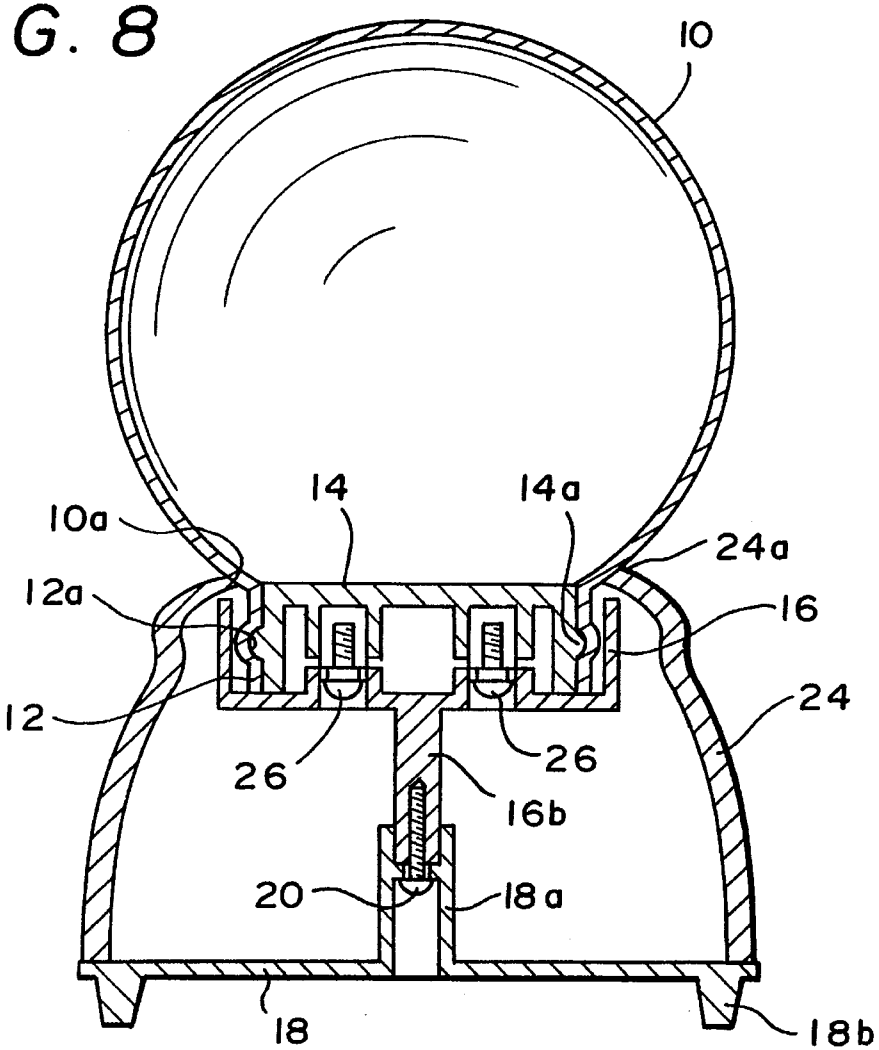
FIG. 8 is a vertical, cross-sectional view of a fourth embodiment of the display device according to the present invention.

This embodiment may be modified so as to removably attach the transparent housing 10/stopper member 14 assembly to the support ring 16, as illustrated in FIGS. 8–10. This is accomplished by forming the stopper member 14 with one or more downwardly extending bosses 14*c* which define openings 14*b*. Openings defined by the support ring 16 enable threaded fasteners 26 to be inserted through the support ring 16 into the bosses 14*c* so as to removably attach the support ring 16 to the transparent housing 10/stopper member 14 assembly.

Figure 11:
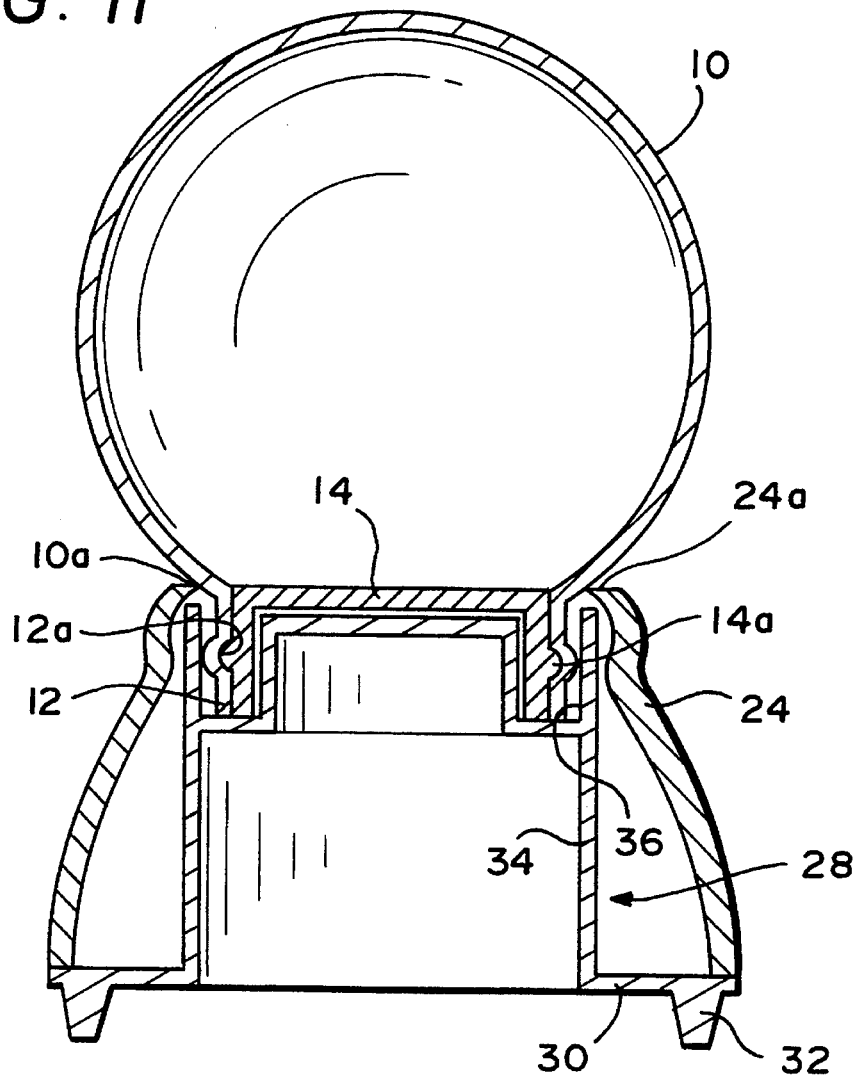
FIG. 11 is a vertical, cross-sectional view of a fifth embodiment of the display deviate according to the present invention.
Figure 12:
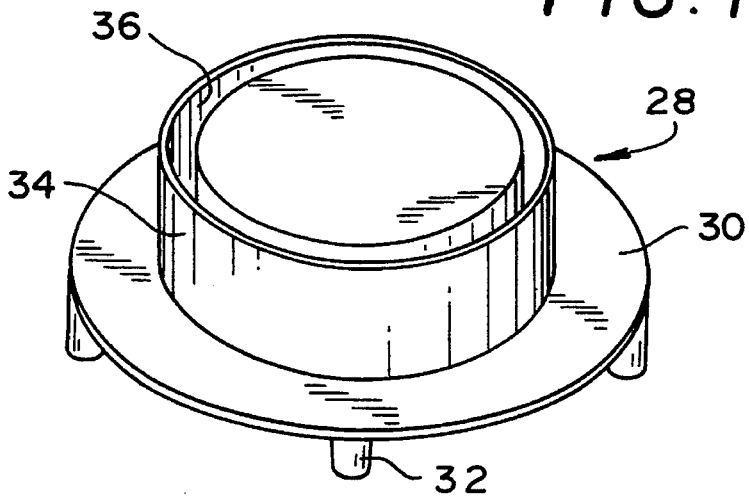
FIG. 12 is a perspective view of the support base utilized with the embodiment illustrated in FIG. 11.

FIGS. 11 and 12 illustrate an alternative embodiment in which the support ring and the support base are formed as an integral support unit 28. Support unit 28 comprises a support base portion 30 having legs 32 extending downwardly therefrom. The support means 28 also has a generally upwardly extending support 34 which, at its distal, uppermost end, defines a recess 36 adapted to receive the neck portion 12 of the transparent housing 10. In this embodiment, the decorative base member 24 is placed onto the support base 30 prior to the attachment of the transparent housing 10/stopper member 14 assembly to the support 34 in the recess 36. Again, contact between portion 10*a* of housing 10 and contact portion 24*a* holds or clamps the decorative base member in position.

Figure 13:
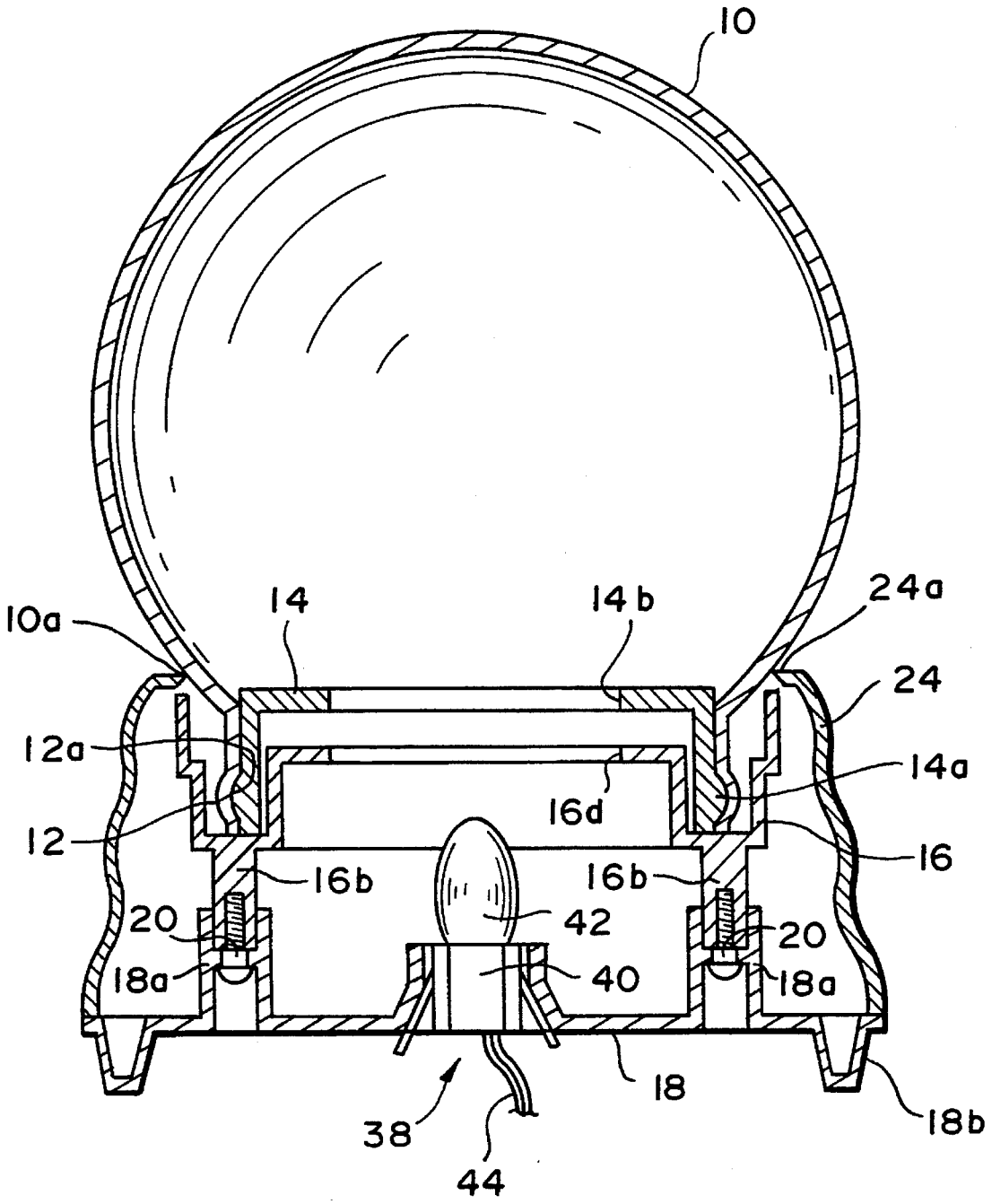
FIG. 13 is a vertical, cross-sectional view of a light source which may be incorporated into the base of any of the preferred embodiments of the resent invention.

It is quite evident that the structures of the aforementioned embodiments may be utilized to display decorative objects without filling the transparent housing 10 with water or other fluids. In this instance, it is possible to provide an illumination device in the base of the decorative display device in order to illuminate the decorative article. As shown in FIG. 13, the stopper member 14 defines an opening 14*b* which is generally in alignment with an opening 16*d* defined by the support ring 16. The decorative article (not shown) may be attached to the stopper member 14 such that it covers opening 14*b*. An illumination device 38, which may comprise socket 40 and light bulb 42, is attached to the base member 18 such that the bulb extends upwardly into the base in alignment with openings 16*d* and 14*b*. Electrical cord 44 may provide electrical power to the bulb 42 and the socket 40 in known fashion.

Figure 14:
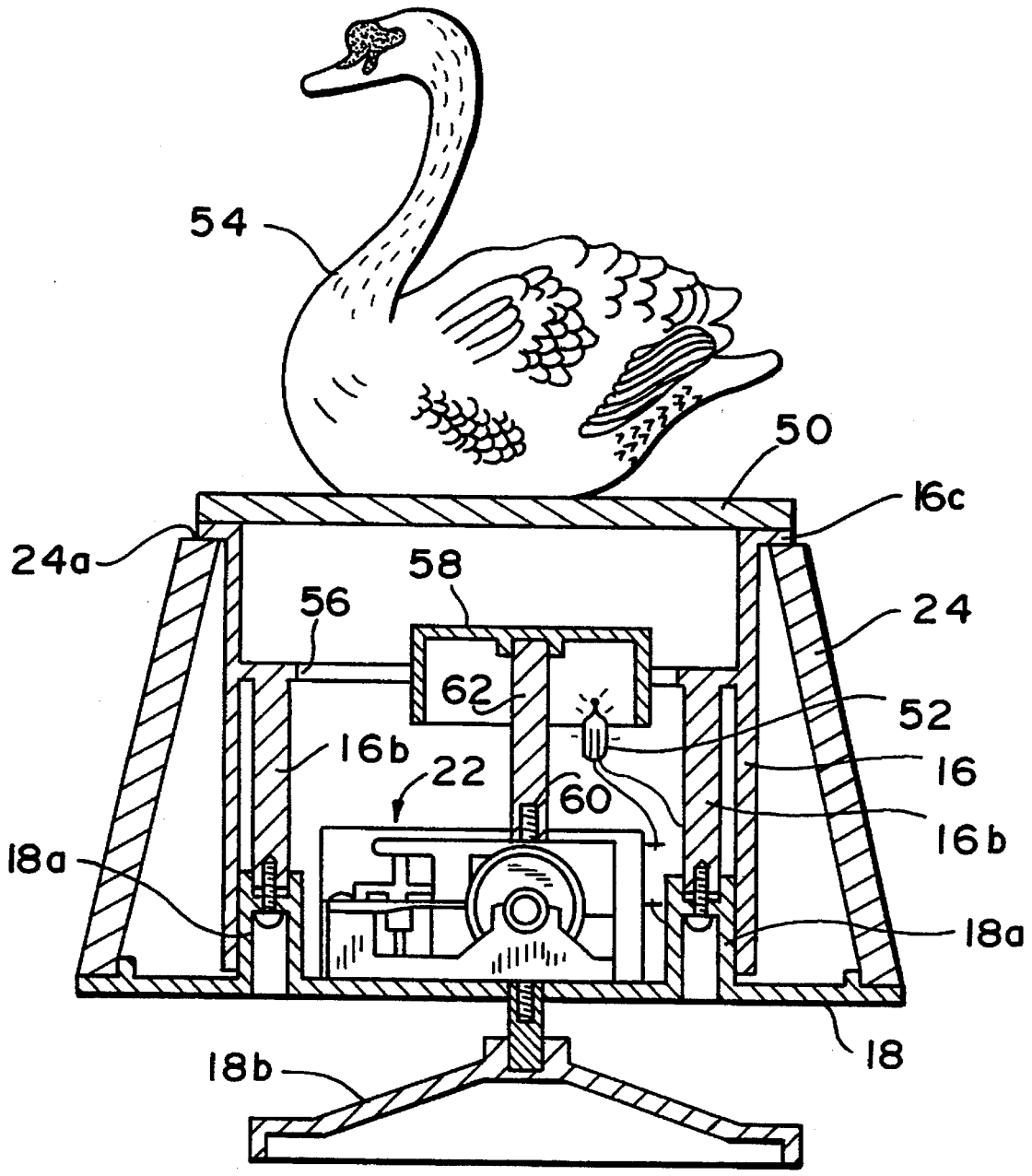
FIG. 14 is a vertical, cross-sectional view of a sixth embodiment of the display device according to the present invention.

FIGS. 14 illustrates another embodiment of the present invention in which the transparent housing 10 and stopper 14 have been replaced by a support plate 50. Support plate 50 may be attached to support ring 16, and this assembly mounted on support base 18 by the engagement of the support rods 16*b* with the supports 18*a*. The attachment of the support ring 16 to the support base 18 holds the decorative base 24 in position on the support base 18, as in the previously described embodiments by the contact between portion 16*c* of support ring 16 and contact portion 24*a* on the decorative base member 24. Such contact clamps the decorative base member 24 between portion 16*c* and support base 18. Music box mechanism 22 may be attached to the support base 18 and located in the interior of the decorative base 24. The various other embodiments of the support ring and support base, previously described, may also be utilized in conjunction with the support plate 50.

The embodiment illustrated in FIG. 14 may also incorporate an electric light bulb 52 which may illuminate the decorative object 54 through the opening 56 defined by the support ring 16. Quite obviously, in this instance, support plate 50 will be transparent or translucent in nature so as to be capable of transmitting the light from bulb 52 onto the decorative object 54.

Color wheel 58 may be attached to an output shaft 60 of the music box mechanism 22 via post 62 so as to rotate with the output shaft 60. Wheel 58 is also transparent or translucent and may have one or more different colors such that, during its rotation, the color of the light illuminating the decorative object 54 may change. Alternatively, the wheel 58 may be fixedly attached to the structure so as to provide a single illumination color.

Figure 15:
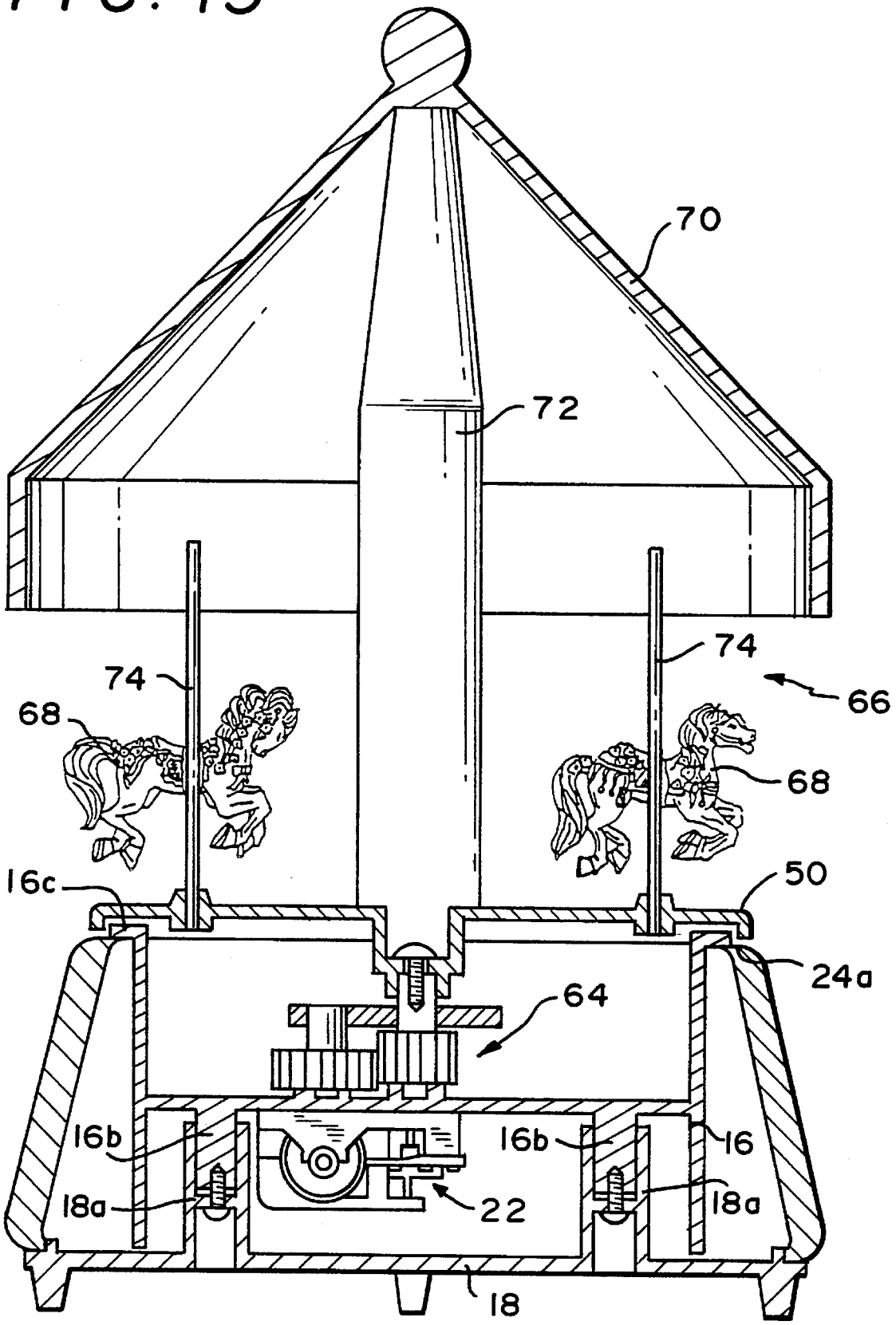
FIG. 15 is a vertical, cross-sectional view of a seventh embodiment of the display device according to the present invention.

In the embodiment illustrated in FIG. 15, the support plate 50 is attached to a gear drive mechanism 64 which is driven by the music box mechanism 22 such that support plate 50 rotates as the music box mechanism operates. Support plate 50 supports the decorative objects 66, which in this particular instance comprises carousel horses 68 and a carousel top 70 which rotate with the support plate 50. As illustrated, carousel top 70 is fixedly attached to support post 72 which, in turn, is fixedly attached to support plate 50. Similarly, carousel horses 68 are mounted on support posts 74 which are also attached to support plate 50. As in the previously described embodiments, the decorative base member 24 is held in position on support base 18 by contact between portion 16*c* and contact portion 24*a* which serves to clamp the decorative base member 24 in position between the support ring 16 and the support base 18.

Figure 16:
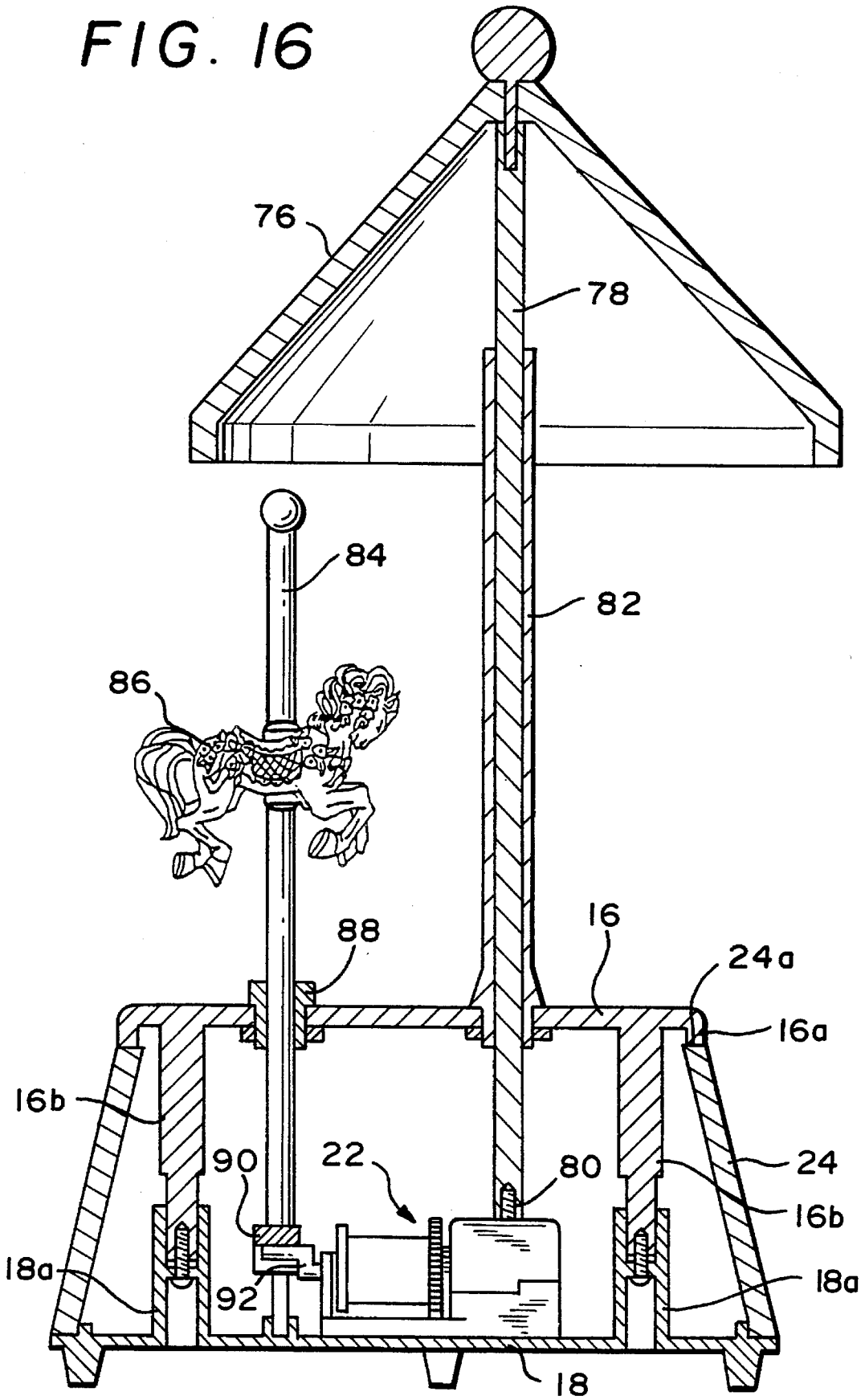
FIG. 16 is a vertical, cross-sectional view of an eighth embodiment of the display device according to the invention.

As illustrated in FIG. 16, it is possible to eliminate altogether the support plate 50. In this embodiment, support ring 16 acts as a support for a decorative object, which in this particular instance comprises a rotatable carousel top 76 fixedly attached to post 78 which, in turn, is attached to a rotating output shaft 80 of the music box mechanism 22. Fixed guide post 82, which is fixedly attached to the support ring 16 acts as a support and guide for the rotating shaft 78. Another decorative object, in this particular instance a carousel horse 86 is fixedly attached to support post 84 which slidably extends through support ring 16 via bearing 88. The lower end of support rod 84 is fixedly attached to a follower member 90 engaged by rotating crank 92 driven by the music box mechanism 22. In known fashion, as crank 92 is rotated by the music box mechanism 22, its engagement with follower 90 will cause rod 84, and carousel horse 86, to move up and down relative to the support ring 16.

The foregoing description is provided for illustrative purposes only and should not be construed as in way limiting this invention, the scope of which is define solely by the appended claims.

I claim:

1. An improved support structure for a decorative display device comprising:

a) a support base having at least one support extending therefrom;

b) a decorative base member separate from the support base and located on the support base, the decorative base member having a contact portion;

c) a decorative object support separate from the decorative base member and comprising a support ring;

d) means on the decorative object support in contact with the contact portion of the decorative base member; and e) means for attaching the support ring to the at least one support such that the contact between the contact portion of the decorative base member and the means on the decorative object support clamps the decorative base member against the support base wherein the means to attach the support ring to the at least one support comprises:

i) at least one support rod extending from the support ring; and, b) fastening means to fasten the at least one support rod to the at least one support.

2. The improved support structure for a decorative display device of claim 1 wherein the decorative object support further comprises:

a) a transparent housing having a bottom portion defining a bottom portion opening; and, b) a stopper member fitted within the bottom portion so as to cover the bottom opening.

3. The improved support structure for a decorative display device of claim 2 wherein the support base comprises a support member adapted to rest on a support surface.

4. The improved support structure for a decorative display device of claim 2 further comprising fastening means to attach the support ring to the stopper member.

5. The improved support structure for a decorative display device of claim 4 wherein the fastening means comprises a threaded fastener.

6. The improved support structure for a decorative display device of claim 1 wherein the decorative base member has a generally annular configuration.

7. The improved support structure for a decorative display device of claim 1 wherein the decorative base member is formed of glass material.

8. The improved support structure for a decorative display device of claim 1, wherein the at least one support has a distal end and further comprising a recess defined by the decorative object support facing the at least one support and configured to engage the distal end of the at least one support.

9. The improved support structure for a decorative display device of claim 1 wherein the fastening means comprises a threaded fastener.

10. The improved support structure for a decorative display device of claim 1 further comprising a plurality of supports extending from the support base and a plurality of support rods extending from the support ring.

11. The improved support structure for a decorative display device of claim 1 wherein the support ring comprises a pair of support ring portions hingedly attached together.

12. The improved support structure for a decorative display device of claim 11 further comprising fastening means operatively associated with the pair of support ring portions so as to prevent relative movement of the portions about their hinged attachment.

13. The improved support structure for a decorative display device of claim 1 further comprising a music box located within the decorative base member.

14. The improved support structure for a decorative display device of claim 1 further comprising illuminating means located within the decorative base member.

15. The improved support structure for a decorative display device of claim 14 wherein the illumination means comprises an electric light assembly.

16. The improved support structure for a decorative display device of claim 14 further comprising a decorative object located on the decorative object support such that it is illuminated by the illumination means.

17. The improved support structure for a decorative display device of claim 14 further comprising attachment means to removably attach the illumination means to the support base.

18. A display device comprising:

a) a support member having at least one support extending therefrom;

b) a decorative base separate from the support member and supported on the support member, the decorative base defining an interior;

c) stationary support ring means separate from the decorative base for supporting a decorative object thereon, the support ring means having at least one support rod extending therefrom located so as to extend into the interior of the decorative base and engage the at least one support; and d) a music box located within the interior of the decorative base.

19. The display device of claim 18 wherein the support ring means comprises:

a) a support ring having the at least one support rod extending therefrom; and, b) a support-plate for supporting a decorative object thereon.

20. An improved support structure for a decorative display device comprising:

a) a support base having at least one support extending therefrom;

b) a decorative base member separate from the support base and located on the support base, the decorative member having a contact portion;

c) a decorative object support separate from the decorative base member comprising a support ring having a pair of support ring portions hingedly attached together;

d) means on the decorative object support in contact with the contact portion of the decorative base member; and e) means for attaching the decorative object support to the support base such that the contact between the contact portion of the decorative base member and the means on the decorative object support clamps the decorative base member against the support base.

21. The improved support structure for a decorative display device of claim 20 wherein the decorative object support further comprises:

a) a transparent housing having a bottom portion defining a bottom opening; and, b) a stopper member fitted within the bottom portion so as to cover the bottom opening.

22. The improved support structure for a decorative display device of claim 21 wherein the support base comprises a support member adapted to rest on a support surface.

23. The improved support structure for a decorative display device of claim 21 further comprising fastening means to attach the support ring to the stopper member.

24. The improved support structure for a decorative display device of claim 20 wherein the decorative base member has a generally annular configuration.

25. The improved support structure for a decorative display device of claim 20 wherein the decorative base member is formed of glass material.

26. The improved support structure for a decorative display device of claim 20 wherein the at least one support has a distal end and further comprising a recess defined by the decorative object support facing the at least one support and configured to engage the distal end of the at least one support.

27. The improved support structure for a decorative display device of claim 20 wherein the attachment means comprises means to attach the support ring to the at least one support.

28. The improved support structure for a decorative display device of claim 20 further comprising a plurality of supports extending from the support base and a plurality of support rods extending from the support ring.

29. The improved support structure for a decorative display device of claim 20 further comprising fastening means operatively associated with the pair of support ring portions so as to prevent relative movement of the portions about their hinged attachment.

30. The improved support structure for a decorative display device of claim 20 further comprising a music box located within the decorative base member.

31. The improved support structure for a decorative display device of claim 20 further comprising illuminating means located within the decorative base member.

32. The improved support structure for a decorative display device of claim 31 wherein the illumination means comprises an electric light assembly.

33. The improved support structure for a decorative display device of claim 31 further comprising a decorative object located on the decorative object support such that it is illuminated by the illumination means.

34. The improved support structure for a decorative display device of claim 31 further comprising attachment means to removably attach the illumination means to the support base.

35. A display device comprising:

a) a support member having at least one support extending therefrom;

b) a decorative base on the support member, the decorative base defining an interior;

c) stationary support ring means separate from the decorative base for supporting a decorative object thereon, the support ring means having at least one support rod extending therefrom located so as to extend into the interior of the decorative base and engage the at least one support; and d) a music box located within the interior of the decorative base.

36. The display device of claim 35 wherein the support ring means comprises:

a) a support ring having the at least one support rod extending therefrom; and b) a support plate for supporting a decorative object thereon.

* * * * *